United States Patent [19]

Strickland, Jr.

[11] 4,036,359

[45] July 19, 1977

[54] BALED WOOD CHIPS

[75] Inventor: Claudius R. Strickland, Jr., Ashburn, Ga.

[73] Assignee: American Hoist & Derrick Company

[21] Appl. No.: 692,055

[22] Filed: June 2, 1976

Related U.S. Application Data

[63] Continuation of Ser. No. 431,104, Jan. 7, 1974, abandoned.

[51] Int. Cl.[2] ..... B65D 71/00

[52] U.S. Cl. ..... 206/83.5; 100/37; 53/24

[58] Field of Search ..... 206/83.5; 100/37; 53/24

[56] References Cited

U.S. PATENT DOCUMENTS

| | | | |
|---|---|---|---|
| 247,125 | 9/1881 | Smith | 206/83.5 |
| 254,326 | 2/1882 | Jaeger | 206/83.5 |
| 2,295,287 | 9/1942 | Muench | 206/83.5 |
| 2,841,500 | 7/1958 | Hughes et al. | 206/83.5 UX |
| 3,040,882 | 6/1962 | Van Beckum et al. | 206/83.5 |

*Primary Examiner*—George T. Hall
*Attorney, Agent, or Firm*—Harvey C. Barber, Jr.

[57] ABSTRACT

A wood chip product and a process for baling wood chips in which sufficient compressive pressure is applied to a quantity of wood chips to substantially reduce its volume, and force the water liquid from the chips to create, without any binder, an adhered but separable compact mass of chips. The mass is enclosed in a flexible web cover, retained by spaced, circumferential ties which extend in the direction of compression. The chips are thus reduced to from one-half to one-sixth of their bulk or volume and have lost from about 15% to about 40% of their weight.

4 Claims, 5 Drawing Figures

BALED WOOD CHIPS

This is a continuation of application Ser. No. 431,104, filed Jan. 7, 1974.

BACKGROUND OF THE INVENTION

This invention relates to wood chips and is more particularly concerned with a wood chip product and a process of producing the same.

In the past timber, which is to be used for pulpwood, has been transported as equal length and size, debarked logs to a pulp mill where the logs were then processed into chips for further treatment to produce the cellulosic pulp fibers from which the paper was made. This, of course, entailed cutting, delimbing and debarking each tree in the field. Such an operation, to be economical, required, as a rule, the systematic growing and systematic harvesting of a single species of tree. The operation also required chipping in the pulp mill.

When land is cleared, many types and sizes of trees are cut. Therefore, such an operation does not lend itself well to the production of trees for pulp purposes. Instead, these trees are usually burned or hauled away and discarded or segregated and sold for different purposes. Recently, with the advent of the large wood chipper capable of progressively chipping whole trees including their limbs, the conversion of such trees directly into chips, on the site, has become increasingly popular. Such chips are either blown directly onto the ground or, blown, as non-compressed loose chips, into closeable truck vans for transportation to a paper mill. Such transportation, by van, is so costly that only short hauls of the chips are feasible. Indeed, even when stored in the hole of a freighter, the transportation of loose chips is presently so costly that such chips can not be economically employed by a pulp mill.

SUMMARY OF THE INVENTION

Briefly described, the present invention which reduces the difficulty described above includes producing a compacted mass of wood chips by applying pressure to the chips in one direction, generally perpendicular to the planes of the chips. In another embodiment, the compaction is applied in two directions, one essentially perpendicular to the general planes of the chips, and a second, perpendicular to the direction of first compaction.

The invention contemplates the application of sufficient pressure to exude the "water" or watery liquid from the chips but insufficient to exude any appreciable tallows, oils or tars. The resulting mass is approximately one-half to approximately one-sixth its uncompacted volume, while from about 15% to about 40% of the total weight of the chips has been forced from the chips, as "water".

With such compaction, the fibers of the wood of the contiguous chips have been implanted into each other, without the need for a binder.

The chips are then covered with a flexible web and baled with ties.

DETAILED DESCRIPTION

In more detail the present invention includes producing wood chips using a conventional wood chipper (not shown). The entire green tree can be subjected to a chipper or simply the debarked trunk. In any event green moist chips are produced. Such chips can be produced from a large variety of wood both soft and hard, including all species of pine, oak, popular, fir, spruce, hickory, walnut, redwood, cedar, black gum, pecan and mahogany. The thickness of the raw green chip can vary up to about one inch. The lowest practical thickness of the chip is about 1/32 inch. Indeed, saw dust can be baled, using the present process, if desired. Furthermore, bark shavings from a chipper or planing mill or bark recovered from a debarker operation can be used. Thus, the term, wood chips, as used hereinafter, should be construed to include a large variety of wood from a variety of trees.

The chips are then compressed. The compressing operation includes placing the wood chips in a press, one or more sides or faces of which are movable for compacting the chips. The press should have holes or openings so that the exuded water is free to be discharged by gravity.

Figure 1:
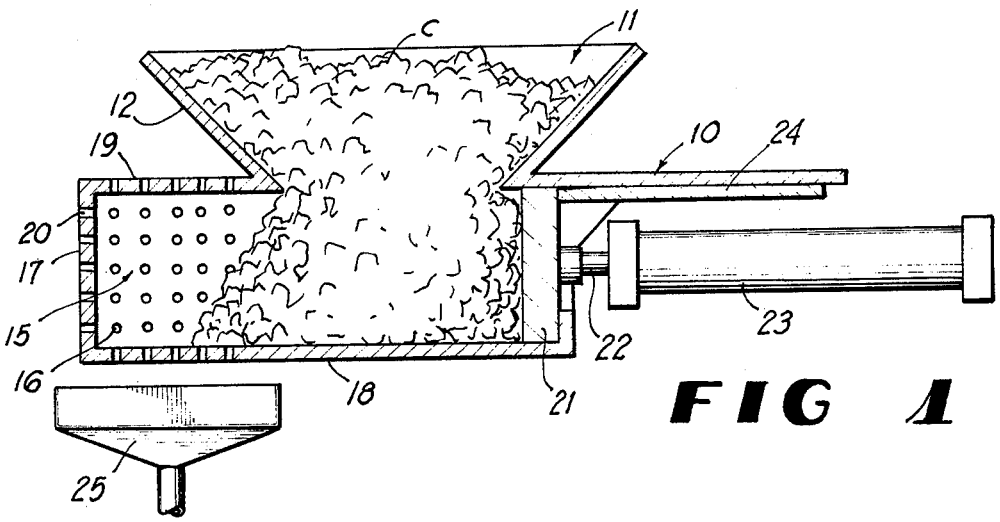
FIG. 1 is a side elevational view, partially broken away showing a single acting press receiving wood chips according to the present invention.
Figure 2:
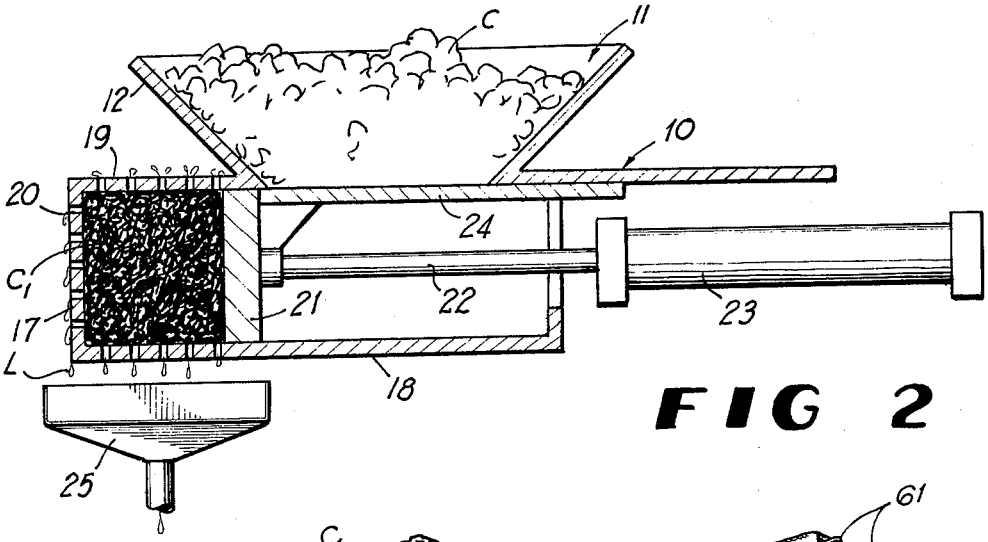
FIG. 2 is a view similar to FIG. 1 and showing the chip being compressed in a single direction.

In FIGS. 1 and 2 a suitable single acting press 10 is depicted. This single acting press 10 includes a hopper or chute having inclined, flat, traperzoidal, downwardly converging sides, such as sides 12, 13 and 14, which are connected together by their edges to define a chute of progressively downwardly decreasing rectangular cross-section. The discharge or lower end of hopper 11 communicates with the chamber 15 of the body of the press 10.

This chamber 15 is defined by spaced, opposed, complimentary, upright, rectangular, parallel, side walls, such as wall 16, the ends of which are joined by a transverse end wall 17. The bottom edges of the walls, such as wall 16, are joined by a bottom wall 18, while the top edges of the walls, such as wall 16, are joined by top wall 19. Top wall 19 is shorter than bottom wall 17 and side walls such as wall 16, and extends from the lower edge of side 12 to the upper edge of wall 17. Thus is provided a hollow, rectangular, tubular press body which is closed at its compression end, by wall 17, and is open at its opposite or ram end, having three equal length walls, such as walls 16 and 18, and a shorter wall 19. The walls 16, 17 and 18 are perforated by holes or apertures 20 at the compression end of chamber 15, so as to permit liquid to pass therefrom. One of the walls, such as walls 16, 17 and 18 or 19 is provided with a hinge (not shown) so that the compressed chips $C_1$ maybe readily removed. Extractor rams (not shown) are usually used for this purpose.

The chamber 15 receives a rectangular compression ram or piston 21 which is connected to and moved by one end of an actuator rod or shaft 22. The shaft 22 controls the piston 21 and, in turn, is extended from and retracted into a hydraulic or pneumatic cylinder 23, for moving piston 21 from its retracted non-compressing position, as shown in FIG. 1 to its compression position, as shown in FIG. 2.

Aligned with the upper edge of piston 21 and extending rearwardly therefrom, is a gate plate 24, the function of which is to close the hopper or chute 11 during the compression of the chip C to their compressed or compacted condition, as shown at $C_1$ in FIG. 2. Any liquid L from the compressed chips C will pass through the apertures 20 and be collected by a drain pan 25, below the compression end of the press 10.

Figure 5:
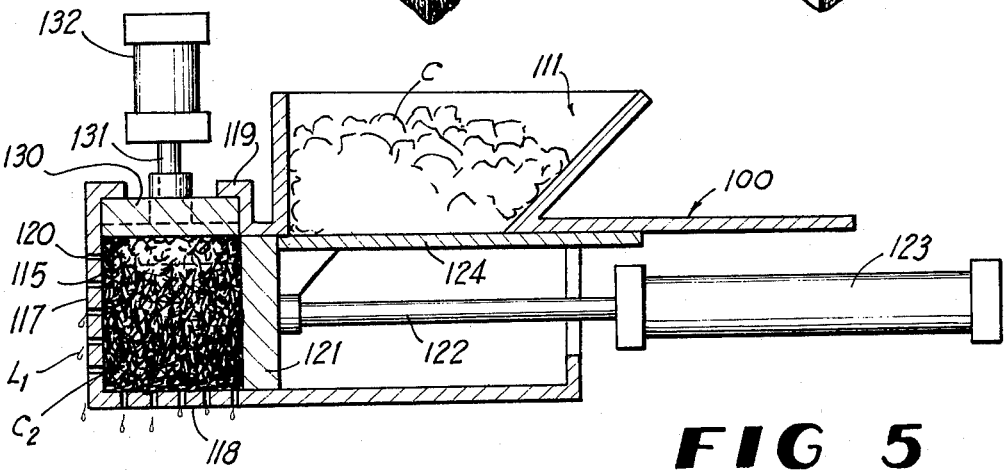
FIG. 5 is a view similar to FIG. 2 but showing a double acting press in place of the single acting press.

If desired, the single acting press depicted in FIG. 1 can be converted to a double acting press 100, as depicted in FIG. 5. This press 100 is identical to the press 10 of FIG. 1 and 2 in that it has a hopper 111 having sides 112, 113 and 114, a chamber 115 defined by walls 116, 117 and 118, the walls 116, 117, and 118 being provided with holes 120 and also has a piston 121, piston shaft 122, cylinder 123 and gate plate 124.

The press 100 has an additional ram, denoted by numberal 130, which is received in top wall 119, the ram 130 being actuated by a piston rod or shaft 131 controlled by a cylinder 132.

In operation, wood chips C are loaded into hopper 11 or 111 so that the fall, by gravity, into chamber 15 or 115, as the case may be. The cylinder 23 or 123 is then actuated to extend the shaft 22 or 122, thereby causing the ram or piston to move, from right to left in FIG. 1, 2 or 5, so as to compress and compact the chips C into a compressed condition as seen at $C_1$ or $C_2$ in FIGS. 2, 3 and 5 with sufficient pressure that the water in the chips is forced therefrom.

In FIG. 5, after ram 121 has moved to its most extended position as shown in FIG. 5, the ram or piston 130 is moved downwardly to further compress the chips $C_2$.

As the chips C are compressed by ram 21 or 121 to chips $C_1$ or $C_2$, the clear "water" phase or liquid L or $L_1$, is exuded or forced from the chips through holes 20 or 120. This exuding of the liquid $L_1$ continues as ram 130 further compresses the chips $C_2$. In such an operation, it is important that the compression be carried only far enough to drive from chips $C_1$ or $C_2$, the water or clear liquid $L_1$ or $L_2$ without driving out any appreciable amount of the tallows, oils or tars, which remain in the chips. In such a compression, the ram face pressure applied by ram 21 or 121 to the chips is from 500 pounds per square inch to 5,000 pounds per square inch. This ram face pressure, however, is preferably about 1,600 pounds per square inch.

Usually the liquid L or $L_1$ forced from the chips constitutes from about 15% to about 50% of the total weight of the chip. After compression the chips $C_1$ or $C_2$ occupy from about one-half to about one-sixth their original volume and have from about 60% to about 85% of their previous weight. The fact that the water has been removed and the compacted chips produced does not materially effect the usefulness of the chips in a paper pulp operation.

In their compressed or compacted condition the fibres of the chips retain their integrity and are forced into intermeshment so that adjacent chips cling together.

Once in a compressed condition, the chips $C_1$ and $C_2$ do not spring back to their normal shape and size. Hence, the baling operation can be accomplished either while the chips $C_1$ or $C_2$ are under compression or after the pressure has been removed.

Figure 3:
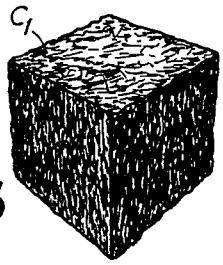
FIG. 3 is a perspective view of a mass of compressed wood chips of the present invention, as discharged from the press of FIGS. 1 and 2.
Figure 4:
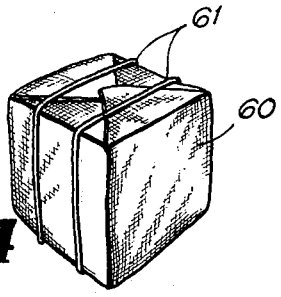
FIG. 4 is a view similar to FIG. 3 but showing the mass of wood chips, as baled.

In FIG. 3 a mass or quantity of compacted intermeshed chips $C_1$ is illustrated, the mass retaining its right prism or cubicle size and shape after the pressure has been removed and the mass has been discharged.

For shipment or storage, a cover or wrapper 60, seen in FIG. 5, of burlap, polyethylene or other inexpensive flexible web material is placed around the mass of chips $C_1$. Also, ties, bales, straps or wire or cord hoops 61 are passed around the chips C, such ties, bales, straps, or hoops 61 being spaced from each other and extending in the direction in which the chips were compressed. In some instances, the mass of chips C, need not be covered by wrapper 60 and/or need not be baled with bales 61.

It is now seen that the chips $C_1$ or $C_2$ are in a convenient cube or right prism shape for being stored in a box car, in the hole of a ship or in a trailer for transportation to a mill. The dense condition and uniform shape permits the chips to be shipped economically over long distances.

What is claimed is:

1. A wood chip product suitable for producing paper pulp comprising a quantity of green, naturally moist wood chips in a compressed condition generally perpendicular to the general planes of said chips and having the fibres of adjacent chips intermeshed, said fibres retaining their integrity, said quantity of wood chips occupying from approximately one-half to approximately one-sixth its normal volume and having a substantially reduced quantity from its normal amount of clear liquid, therein.

2. A green naturally moist wood chip product consisting essentially of compressed wood chips from which a portion of its water has been exuded.

3. The wood chip product defined in claim 1 wherein said chips have been subjected to a pressure from one direction of from 500 pounds per square inch to 5,000 pounds per square inch and in which from about 15% to about 40% of said moisture has been removed.

4. The wood chip product defined in claim 3 including ties surrounding said wood chips.

* * * * *